United States Patent [19]

Hsuih

[11] Patent Number: 4,947,486

[45] Date of Patent: Aug. 14, 1990

[54] GLOVE LINER APPARATUS

[75] Inventor: Chi H. Hsuih, Jackson Heights, N.Y.

[73] Assignee: Fairdon Industrial Limited, Hong Kong, Hong Kong

[21] Appl. No.: 297,474

[22] Filed: Jan. 13, 1989

[51] Int. Cl.[5] ..... A41D 19/00

[52] U.S. Cl. ..... 2/164; 2/159; 2/169

[58] Field of Search ..... 2/158, 159, 163, 164, 2/169, 170, 161 A, 161 R, 16, 20; 15/227

[56] References Cited

U.S. PATENT DOCUMENTS

| | | | |
|---|---|---|---|
| 244,949 | 7/1881 | Thurman | 2/158 |
| 261,040 | 7/1882 | Price | 2/169 X |
| 763,736 | 6/1904 | Doppenschmitt | 2/158 X |
| 4,270,228 | 6/1981 | Gaiser | 2/161 R X |
| 4,420,843 | 12/1983 | Genzling et al. | 2/161 A |
| 4,587,672 | 5/1986 | Madnick et al. | 2/158 |
| 4,748,693 | 6/1988 | Shinn | 2/164 |

FOREIGN PATENT DOCUMENTS

| | | | |
|---|---|---|---|
| 830038 | 3/1960 | United Kingdom | 2/159 |

*Primary Examiner*—Werner H. Schroeder
*Assistant Examiner*—Sara M. Current
*Attorney, Agent, or Firm*—Jay K. Malkin

[57] ABSTRACT

A glove liner of superior absorbency, comfort and utility is disclosed. The liner is of unitary construction, and includes a substantially tubular body portion of absorbent, stretchable material having a uniform width along its entire length. The body portion includes a side opening sized to accommodate a user's thumb. A second side opening for the user's little finger may also be provided across from the first side opening. At the top of the body portion, multiple finger openings are provided. The entire liner is of seamless construction and minimal weight. The unitary design for the liner is especially suited for mass production, and the final product is highly moisture-absorbent and comfortable.

22 Claims, 2 Drawing Sheets

GLOVE LINER APPARATUS

BACKGROUND OF THE INVENTION

This invention generally relates to a glove liner, and more particularly to a glove liner of improved design, utility, and comfort.

In recent years, the use of protective gloves for a wide variety of purposes has increased dramatically. There are virtually hundreds of different glove types currently in use today. For example, leather double-ply gloves are used to protect the hands of welders, lumber workers, and heavy machine operators. Latex gloves are widely used for household cleaning purposes. Likewise, latex and plastic gloves protect the hands of workers in the meat packing, fish processing, canning and baking industries.

Protective gloves are especially important in the medical field where contact with human blood is possible. Contact with human blood is undesirable in view of numerous blood-transmissible diseases, including AIDS (Aquired Immune Deficiency Syndrome).

However, many types of gloves are uncomfortable and difficult to wear for numerous reasons. Heavy work gloves, as well as impermeable plastic or rubber gloves often allow moisture to collect between the wearer's hands and the gloves. This is especially true with respect to medical gloves which have a high degree of fluid/air impermeability. Moisture generation is typically caused by perspiration and heat from the user's hands inside the gloves. This results in hand irritation, discomfort, and decreased manual dexterity. Also, many types of gloves are not properly lined in order to protect the user from temperature extremes and physical shocks to the hands encountered during labor.

As previously noted, numerous types of gloves currently used for work and sports activities are made of leather. It is important that these gloves be comfortable to wear, warm in the winter, and dry and clean in the summer. However, these goals are often difficult to attain, especially if moisture collects between the user's hands and the gloves. Such moisture not only causes discomfort, but leads to decomposition and degradation of the leather.

In addition, gloves used in heavy industries such as ship-building, mining, and lumber processing frequently incorporate large, open safety cuffs which allow the entry of wood chips, metal fragments, dirt, and other debris. These materials then contact the wearer's hands inside the gloves which may cause irritation or injury.

The present invention involves liners worn inside all types of gloves to improve comfort, absorb moisture, protect the hands and lengthen the useful life of the gloves involved. Previously, glove liners have been manufactured for a variety of purposes. Shinn U.S. Pat. No. 4,748,693 discloses an absorbent liner which, in one embodiment, includes a body portion having a plurality of tubular, outwardly extending members designed for placement about the inner segments of the fingers. Price U.S. Pat. No. 2,261,040 also discloses a glove liner in both mitten form and conventional form having a plurality of finger-receiving portions. Madnick et al U.S. Pat. No. 4,587,672 discloses a glove liner having finger openings and a pouch designed to contain a chemical heating element for use in cold weather. Genzling et al U.S. Pat. No. 4,420,843 discloses a liner used by cyclists inside cycling gloves for improved comfort.

Notwithstanding the liners described above, a need currently exists for a moisture-absorbent protective liner for gloves used in a variety of different fields. The present invention satisfies this need and represents an advance in the art of glove liner design as described herein.

SUMMARY OF THE INVENTION

It is an object of the present invention to provide a glove liner capable of absorbing moisture and protecting the hands during the use of work and medical gloves.

It is another object of the invention to provide a glove liner of unitary, single-piece construction.

It is another object of the invention to provide a glove liner which is designed for mass production at minimal cost.

It is a further object of the invention to provide a glove liner which provides maximum comfort, is easy to wear, and protects the hands from physical shocks and adverse temperature conditions encountered during labor.

It is an even further object of the invention to provide a glove liner which is constructed using a minimal number of manufacturing steps.

It is a still further object of the invention to provide a glove liner in which one size fits all users.

In accordance with the foregoing objects, a glove liner of superior absorbency, comfort, and utility is disclosed. The liner is of unitary, single-piece construction and includes a substantially tubular body portion of absorbent, stretchable material having a uniform width along the entire length of the body portion. The body portion includes a side opening below the top of the liner which is sized to accommodate a user's thumb. On the opposite side of the body portion below the top of the liner, a second side opening may be provided for the user's little finger. At the top of the body portion, a plurality of finger openings are provided which are each separated from each other. The entire liner is of seamless construction, of minimal weight, and designed to fit different sized hands. The liner is designed for mass production at a minimal cost, and the final product is highly effective and comfortable.

These and other objects, advantages and features of the invention shall be described below in the following brief description of the drawings and detailed description of a preferred embodiment.

DETAILED DESCRIPTION OF A PREFERRED EMBODIMENT

In accordance with the present invention, an absorbent glove liner of improved design is disclosed. The liner is designed to absorb moisture which is generated when gloves are worn, and provide an enhanced degree of user comfort/protection.

Figure 1:
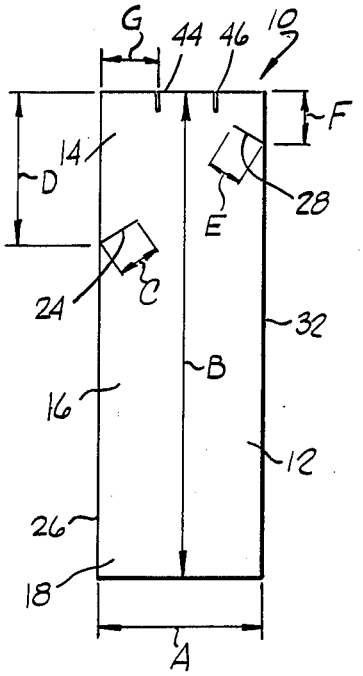
FIG. 1 is a side view of a glove liner produced in accordance with the invention in a flat configuration.
Figure 2:
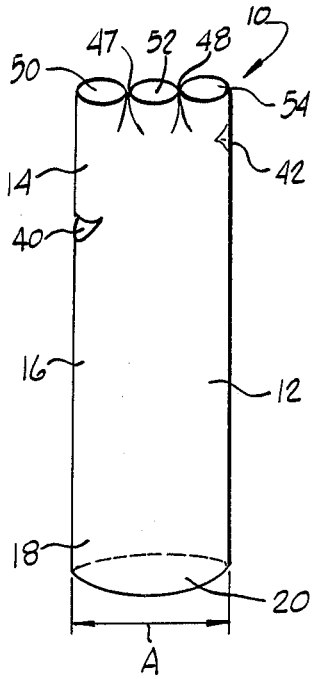
FIG. 2 is a perspective view of the liner of FIG. 1 in a partially expanded condition showing the tubular form of the liner.

With reference to FIGS. 1 and 2, a seamless liner 10 is disclosed which includes a flexible tubular body portion 12. The body portion 12 has an upper section 14, a medial section 16, and a lower section 18. The lower section 18 has an opening 20 (FIG. 2) sized for receiving a user's hand therethrough. The width "A" of the body portion 12 (FIGS. 1 and 2) is substantially uniform from the upper section 14 continuously downward along the medial section 16 to the lower section 18. The uniform width of the body portion 12 enables the liner 10 to be readily mass produced using conventional equipment and materials, as described below.

The body portion 12 is preferably manufactured of a flexible knitted material which readily stretches, yet is highly absorbent, soft and comfortable. In a preferred embodiment, the body portion is rib-knitted conventionally using 100% cotton yarn of the type normally used to construct cuffs on clothing items. Cotton is desirable in that it is comfortable, soft, air-permeable, and generates negligible amounts of static electricity. Likewise, it is sufficiently lightweight and flexible to not interfere with the movement and dexterity of the user's hands and fingers. It is also possible to manufacture the body portion 12 from wool, acrylic, or blended yarn materials known in the art.

With continued reference to FIG. 1, the body portion 12 includes a first upwardly-angled slit 24 cut into the body portion 12 at side 26 below upper section 14 as illustrated. Cut through the opposite side 32 of the body portion 12 and across from slit 24 is a second upwardly-angled slit 28. The slit 28 is closer to the upper section 14 of the body portion 12 than the slit 24 for the reasons described below.

When the body portion 12 is expanded to form a tubular structure as shown in FIG. 2, the first slit 24 becomes an opening 40 sized to receive a user's thumb therethrough. Likewise, the second slit 28 becomes an opening 42 sized to receive a user's little finger. The higher position of the slit 28 on the body portion 12 compared with slit 24 is provided because a user's little finger is attached to the hand at a higher position than that of the thumb.

In the embodiment of FIG. 1, two stitches 44, 46 are made through the upper section 14 at or slightly below the upper edge thereof which are equally spaced from each other. In a preferred embodiment, the stitches 44, 46 are fabricated using a conventional bar-tacking sewing machine, although fabrication maybe accomplished using other methods. In the tubular, expanded configuration of FIG. 2, the stitches 44, 46 form fabric bridges 47, 48 which define three separate finger openings 50, 52, 54. The openings 50, 52, 54 are substantially equal in size, and adapted to receive the user's second, third, and fourth fingers, respectively.

Figure 6:
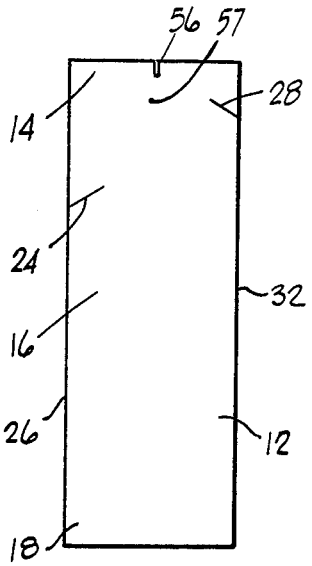
FIG. 6 is a side view of an alternative embodiment of a glove liner produced in accordance with the invention in a flat configuration.
Figure 7:
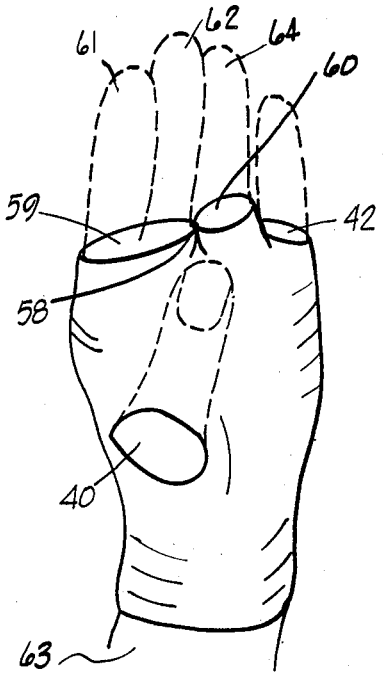
FIG. 7 illustrates the liner of FIG. 6 on the hand of a user in which the fingers are shown in dashed lines so that the finger openings may be viewed.

In an alternative embodiment shown in FIG. 6, only one stitch 56 is made at the middle 57 of the upper section 14 of body portion 12. This forms a single fabric bridge 58 (FIG. 7) which defines two finger openings 59, 60 substantially equal in size, although able to stretch when worn as shown in FIG. 7. Each of the openings 59, 60 is designed to receive one or two of the user's second, third, and fourth fingers. In FIG. 7 the second finger 61 and third finger 62 of a hand 63 pass through opening 59, while the fourth finger 64 is in opening 60.

Figure 8:
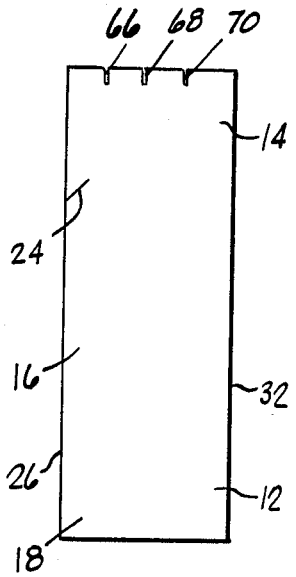
FIG. 8 is a side view of an additional alternative embodiment of a glove liner produced in accordance with the invention in a flat configuration.
Figure 9:
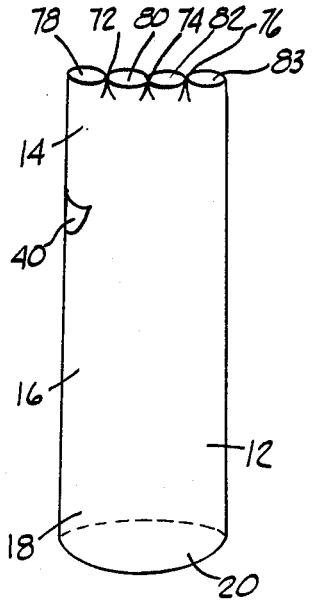
FIG. 9 is a perspective view of the liner of FIG. 8 in a partially expanded condition showing the tubular form of the liner.

In an additional embodiment shown in FIGS. 8 and 9, three stitches 66, 68, 70 are made in the upper section 14 of the body portion 12. This forms three fabric bridges 72, 74, 76 which define four finger openings 78, 80, 82, 83 (FIG. 9) substantially equal in size, although able to stretch when worn.

Each of the openings 78, 80, 82, 83 is designed to receive the user's second, third, fourth, and little finger, respectively. The liner of FIGS. 8 and 9 also includes slit 24 which becomes opening 40, but does not include slit 28.

Figure 3:
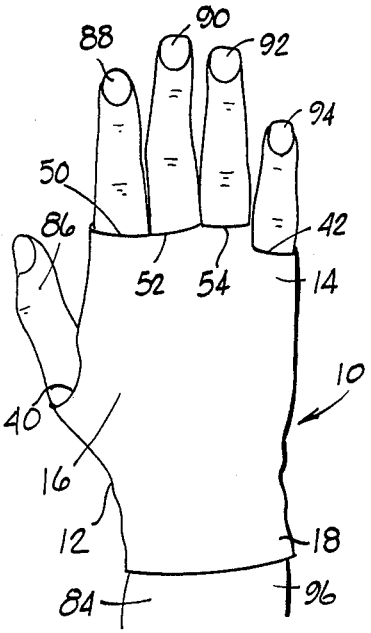
FIG. 3 illustrates the liner of FIG. 1 on the hand of a user (palm facing outward)
Figure 4:
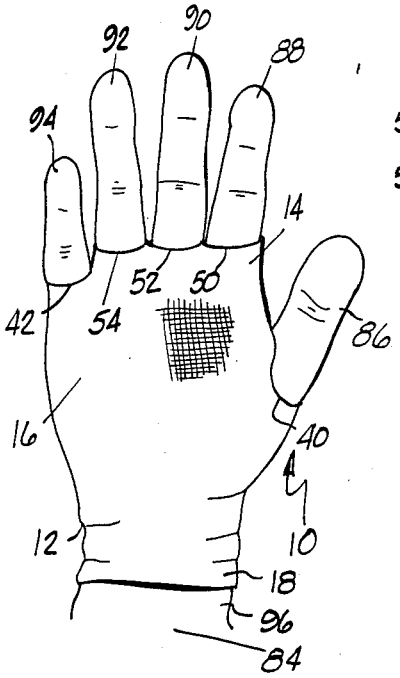
FIG. 4 is another view of the liner of FIG. 1 on the hand of a user (palm facing inward)
Figure 5:
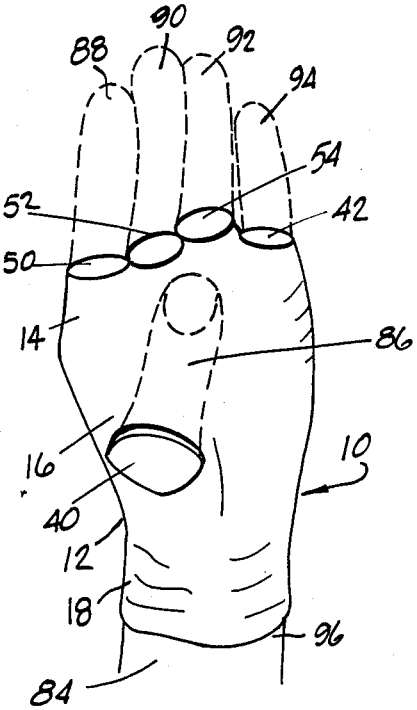
FIG. 5 is a still further view of the liner of FIG. 1 on the hand of user showing the fingers in dashed lines so that the finger openings of the liner may be viewed.

With reference to FIGS. 3–5, the completed liner 10 of FIGS. 1 and 2 is shown on the hand 84 of a user. As illustrated, the user's thumb 86 and fingers 88, 90, 92, 94 extend entirely outward through the openings 40, 50, 52, 54, and 42, respectively, with virtually no portion of the thumb or fingers being covered. This is important, in that it improves the user's manual dexterity. The liner 10 should be sufficiently long so that it terminates at or above the user's wrist 96 (FIGS. 3–5), allowing the entire hand 84 to be covered as illustrated. Even though the body portion 12 has a substantially uniform width along its entire length (FIGS. 1 and 2), the stretchable nature of the material used to construct the body portion 12 enables it to suitably conform to hands of differing size. Likewise, the absorbant nature of the material allows it to effectively prevent moisture from collecting between the user's hands and gloves, as previously noted. Finally, each liner 10 may be readily worn on either the right or left hand.

The structural design of the liner 10 is especially well-suited to large-scale mass production conditions. Specifically, the body portion 12 is first knitted to form a tubular structure in a conventional manner. Thereafter, the first and second slits 24, 28 are cut into the body portion 12 at selected positions below the upper section 14, with the second slit 28 being closer to the finger openings 50, 52, 54 of the upper section 14 than the first slit 24 in the final product. Formation of the slits 24, 28 is facilitated when the body portion 12 is maintained in the flat orientation of FIG. 1, and simply involves one cut through the body portion 12 for each slit 24, 28. Thereafter, stitches 44, 46 are made in the body portion 12, preferably when it is flat (FIG. 1). As noted above, the stitches 44, 46 are normally made using a bar-tack sewing machine although other methods may be used. As far as the order of construction is concerned, the stitches 44, 46 may be made either before or after the formation of slits 24, 28.

The following Example illustrates specific and preferred dimensions, production parameters, and materials used to construct a glove liner in accordance with all embodiments of the invention described herein.

EXAMPLE

To construct a typical glove liner 10, ribbed tubing is used to produce the body portion 12. The tubing is preferably made of 100% cotton, although wool, acrylic, or blended yarns known in the art may be used. In the present Example, the selected material is 100% cotton with a gauge of about 150–250 and a weight of about one pound per 10–20 yards of material.

When in a flat configuration as shown in FIG. 1, the body portion 12 has a width "A" of about 40–70 mm and a length "B" of about 150–250 mm. The first slit 24 is cut into the body portion 12 at an upward angle as illustrated in FIG. 1, and extends inward at a distance "C" of approximately 3–10 mm. The slit 24 is positioned beneath the finger openings 50, 52, 54 of upper section 14 of the body portion 12 by a length "D" of about 50–90 mm. The second slit 28 is cut into the body portion 12 at an upward angle, and extends inward at a distance "E" of about 3–8 mm. The second slit 28 is positioned below the finger openings 50, 52, 54 of the upper section 14 of the body portion 12 by a length "F" of about 10–30 mm. Two stitches 44, 46 are provided each having a length of about 2–9 mm. Each of the stitches 44, 46 is equally spaced from the other as shown, and is positioned slightly below the top edge of the upper section 14 by a distance of about 1 mm. This enables the formation of finger openings 50, 52, 54 each having a width "G" (FIG. 1) of about 14–23 mm.

Having herein described a preferred embodiment of the invention, it is anticipated that suitable modifications may be made thereto by those skilled in the art. For example, changes in the specific dimensions of the liner may be made, as well as modifications in size and selected construction material. Thus, the invention shall only be construed in accordance with the following claims:

What is claimed is:

1. A glove liner comprising:

a body portion having an upper section, a lower section, and a medial section therebetween, said body portion being substantially tubular in configuration and having a uniform width along the entire length of said body portion from said upper section to said lower section, said lower section having an opening therethrough sized to receive the hand of a user;

at least two openings in said upper section sized to receive the second, third and fourth fingers of said user's hand;

a first side opening through said body portion beneath said openings in said upper section, said first side opening being sized to receive said user's thumb therethrough; and a second side opening through said body portion beneath said openings in said upper section and across from said first side opening, the distance from said second side opening to said openings in said upper section being less than the distance from said first side opening to said openings in said upper section, said second side opening being sized to receive said user's little finger therethrough.

2. The glove liner of claim 1 wherein said body portion is comprised of a stretchable material.

3. The glove liner of claim 1 wherein said body portion is about 150–250 mm long.

4. The glove liner of claim 1 wherein said body portion has a width of about 40–70 mm.

5. The glove liner of claim 1 wherein said first side opening extends downwardly below said openings in said upper section by a distance of about 50–90 mm.

6. The glove liner of claim 1 wherein said second side opening extends downwardly below said openings in said upper section by a distance of about 10–30 mm.

7. The glove liner of claim 1 wherein said openings in said upper section comprise three individual openings of equal size.

8. The glove liner of claim 1 wherein said openings in said upper section comprise two individual openings of equal size.

9. A glove liner comprising:

a body portion having an upper section, a lower section, and a medial section therebetween, said body portion being comprised of a stretchable material, said body portion having a length of about 150–250 mm, with a uniform width along the entire length of said body portion from said upper section to said lower section of about 40–70 mm, said lower section having an opening therethrough sized to receive the hand of a user;

at least two openings in said upper section sized to receive the second, third and fourth fingers of said user's hand, said openings being of substantially equal size;

a first side opening through said body portion beneath said openings in said upper section, said first side opening extending downwardly below said openings in said upper section by a distance of about 50–90 mm, said first side opening being sized to receive said user's thumb therethrough; and a second side opening through said body portion beneath said openings in said upper section and across from said first side opening, said second side opening extending downwardly below said openings in said upper section by a distance of about 10–30 mm, said second side opening being sized to receive said user's little finger therethrough.

10. A glove liner comprising:

a body portion having an upper section, a lower section, and a medial section therebetween, said body portion having a uniform width along the entire length of said body portion from said upper section to said lower section, said lower section having an opening therethrough sized to receive the hand of a user;

at least one stitch in and through said upper section, said stitch defining at least two separate openings in said upper section sized to receive the second, third and fourth fingers of said user's hand;

a first slit through said body portion beneath said openings in said upper section, said first slit being adapted for the passage of said user's thumb therethrough; and a second slit through said body portion beneath said openings in said upper section and across from said first slit, the distance from said second slit to said openings in said upper section being less than the distance from said first slit to said openings in said upper section, said second slit being adapted for the passage of said user's little finger therethrough.

11. The glove liner of claim 10 wherein said body portion is about 150–250 mm long.

12. The glove liner of claim 10 wherein said body portion has a width of about 40–70 mm.

13. The glove liner of claim 10 wherein said first slit extends downwardly below said openings in said upper section by a distance of about 50–90 mm.

14. The glove liner of claim 10 wherein said second slit extends downwardly below said openings in said upper section by a distance of about 10–30 mm.

15. A glove liner comprising:

a body portion having an upper section, a lower section, and a medial section therebetween, said body portion being comprised of a stretchable material, said body portion having a length of about 150–250 mm, with a uniform width along the entire length of said body portion from said upper section to said lower section of about 40–70 mm, said lower section having an opening therethrough sized to receive the hand of a user;

at least one stitch in and through said upper section, said stitch defining at least two separate openings in said upper section sized to receive the second, third, and fourth fingers of said user's hand;

a first slit through said body portion beneath said openings in said upper section, said first slit extending downwardly below said openings in said upper section by a distance of about 50–90 mm, said first slit being adapted for the passage of said user's thumb therethrough; and a second slit through said body portion beneath said openings in said upper section and across from said first slit, said second slit extending downwardly below said openings in said upper section by a distance of about 10–30 mm, said second slit being adapted for the passage of said user's little finger therethrough.

16. A method for manufacturing a glove liner comprising:

providing a body portion having an upper section, a lower section, and a medial section therebetween, said body portion being substantially tubular in configuration with a uniform width along the entire length of said body portion from said upper section to said lower section, said lower section having an opening therethrough sized to receive the hand of a user;

applying at least one stitch in at least one position on and through said upper section of said body portion in order to form at least two separate finger openings in said upper section;

cutting a first slit into said body portion below said finger openings in said upper section; and cutting a second slit into said body portion below said finger openings in said upper section and across from said first slit, the distance from said second slit to said finger openings in said upper section being less than the distance from said first slit to said finger openings in said upper section.

17. The method of claim 16 wherein said body portion is comprised of a stretchable material.

18. The method of claim 16 wherein said body portion is about 150–250 mm long.

19. The method of claim 17 wherein said body portion has a width of about 40–70 mm.

20. The method of claim 16 wherein said first slit extends downwardly below said finger openings in said upper section of said body portion by a distance of about 50–90 mm.

21. The method of claim 16 wherein said second slit extends downwardly below said finger openings in said upper section of said body portion by a distance of about 10–30 mm.

22. A method for manufacturing a glove liner comprising:

providing a body portion having an upper section, a lower section, and a medial section therebetween, said body portion having a length of about 150–250 mm, and being substantially tubular in configuration with a uniform width along the entire length of said body portion from said upper section to said lower section of about 40–70 mm, said lower section having an opening therethrough sized to receive the hand of a user;

applying at least one stitch in at least one position on and through said upper section of said body portion in order to form at least two separate finger openings in said upper section;

cutting a first slit into said body portion about 50–90 mm below said finger openings in said upper section; and cutting a second slit into said body portion across from said first slit and about 10–30 mm below said finger openings in said upper section.

* * * * *